US007318631B2

(12) United States Patent
Kreyenkamp

(10) Patent No.: US 7,318,631 B2
(45) Date of Patent: Jan. 15, 2008

(54) CORNER CABINET, ESPECIALLY FOR A KITCHEN

(75) Inventor: Reiner Kreyenkamp, Bad Essen (DE)

(73) Assignee: Heinrich J. Kesseböhmer KG, Bad Essen (DE)

( * ) Notice: Subject to any disclaimer, the term of this patent is extended or adjusted under 35 U.S.C. 154(b) by 153 days.

(21) Appl. No.: 11/160,696

(22) Filed: Jul. 6, 2005

(65) Prior Publication Data

US 2006/0012273 A1 Jan. 19, 2006

(30) Foreign Application Priority Data

Jul. 16, 2004 (DE) ..... 20 2004 011 200 U

(51) Int. Cl.
*A47B 81/00* (2006.01)

(52) U.S. Cl. ..... 312/238

(58) Field of Classification Search ..... 312/24, 312/27, 30, 238, 197, 305, 307, 311; 108/39, 108/40, 140, 103, 139; 211/107, 187, 205, 211/207; 248/235, 239, 241, 243, 244, 245, 248/250, 246, 247

See application file for complete search history.

(56) References Cited

U.S. PATENT DOCUMENTS 719,625 A * 2/1903 Throm ..... 312/27
1,010,950 A * 12/1911 Prather ..... 312/123
1,151,637 A * 8/1915 Weis ..... 108/139
2,237,455 A * 4/1941 Slawski ..... 108/39
3,198,594 A * 8/1965 Murray ..... 312/238
4,582,372 A * 4/1986 Cooper ..... 312/322
4,639,051 A * 1/1987 DeBruyn ..... 312/275
4,959,582 A * 9/1990 Meyer et al. ..... 312/307
2002/0117943 A1* 8/2002 Gerkey et al. ..... 312/238

FOREIGN PATENT DOCUMENTS

| | | |
|---|---|---|
| DE | 94 17 324 | 1/1995 |
| EP | 1163863 | * 12/2001 |
| SE | 465 699 | 10/1991 |
| WO | WO 91/03189 | * 3/1991 |

* cited by examiner

*Primary Examiner*—James O. Hansen
(74) *Attorney, Agent, or Firm*—Gudrun E. Huckett

(57) ABSTRACT

A corner cabinet has a rectangular interior accessible through a door opening. A support column with a vertical swivel axis is arranged in the interior for supporting at least one essentially semi-circular shelf. The shelf is movable from an interior position into an exterior position in which the shelf projects outwardly past a plane of the door opening. First and second guides are connected at a connecting point to the bottom side of each shelf, respectively. The first guide is pivotably connected to the support column. The second guide is connected to support bearing mounted near the door opening on a sidewall and having a swivel axis extending parallel to the swivel axis of the support column. The swivel movement of the shelf from the interior position to the exterior position is controlled commonly by the first and second guides.

30 Claims, 4 Drawing Sheets

CORNER CABINET, ESPECIALLY FOR A KITCHEN

BACKGROUND OF THE INVENTION

The invention relates to a corner cabinet, in particular, for a kitchen, comprising an interior that is rectangular in plan view, wherein at least one half of the interior is accessible from the cabinet front by means of a corner cabinet door. In the interior, at least one unitary (one-part) shelf of a substantial semi-circular basic shape is supported. By means of a fitting comprising a support column with at least one substantially vertical axis of rotation, the at least one shelf is movable from an interior position into an exterior position relative to the corner cabinet in which exterior position the at least one shelf projects outwardly past the plane of the door opening of the corner cabinet.

Known corner cabinets usually have semi-circular shelves arranged in vertical alignment on top one another (DE 94 17 324 U1). The shelves can be rotated about a vertical axis of rotation from their interior position in the corner cabinet into an exterior position in which the shelf or shelves project outwardly by approximately one-half of their size past the plane of the door opening of the corner cabinet. Accordingly, the accessibility to the shelf surface of the shelf is limited.

Also known is a corner cabinet (SE-A-465 699) in which each shelf plane has two shelves that are swivelable individually about separate vertical swivel axes. The first shelf having approximately the shape of a quarter circle is swivelable by approximately 270 degrees into an exterior position in which its shelf surface is located completely outside of the plane of the door opening of the corner cabinet. The second shelf can be swivelled into its exterior position only after the first shelf has been rotated outwardly; in the exterior position, the shelf surface of the second shelf projects by about one half its size past the plane of the door opening of the corner cabinet. Such a configuration requires increased expenditure but it does improve accessibility of the shelf surfaces of the two shelves.

SUMMARY OF THE INVENTION

It is an object of the present invention to provide a corner cabinet and a corner cabinet fitting of the aforementioned kind with which unitary shelves of a shape similar to a semi-circular basic shape can be transferred into an exterior position in which the shelf surface completely, or almost completely, projects past the plane of the door opening of the corner cabinet and is therefore accessible without any restriction.

In accordance with the present invention, this is achieved in connection with a corner cabinet in that the shelf, or each shelf, is supported by two guides that pivotably engage the bottom side of the shelf, respectively, wherein the first guide is swivelable about the support column and the second guide is swivelable about a swivel axis of a support bearing that extends parallel to the swivel axis of the support column, wherein the support bearing is mounted near the door opening on the sidewall delimiting the door opening of the corner cabinet, and wherein the shelf carries out a movement controlled simultaneously by both guides upon transfer from the interior position into the exterior position and back.

In accordance with the present invention, this is achieved in connection with the corner cabinet fitting in that the fitting comprises a vertical support column stationarily supported within the interior of the corner cabinet as a support for at least one unitary shelf of a semi-circular basic shape, wherein the fitting comprises for each shelf two guides supporting the shelf and controlling a movement of the shelf from the interior position in the interior of the corner cabinet into the exterior position in front of the door opening of the corner cabinet, wherein the guides are connectable with one end pivotably to the bottom side of the shelf and with the other end are swivelable about vertical axes that can be positioned stationarily within the interior of the corner cabinet, wherein one of the axes is provided by the support column and the other is provided by a support bearing that is connectable to a sidewall of the corner cabinet delimiting the door opening of the corner cabinet.

The dependent claims define further embodiments of the corner cabinet and the corner cabinet fitting, respectively.

By supporting the at least one shelf by two guides that are swivelable about separate, parallel axes and that are connected pivotably to the bottom side of the shelf, the shelf experiences a movement controlled commonly by these two guides into an exterior position in which exterior position the shelf projects completely, or substantially completely, e.g. up to 90 percent, past the plane of the door opening of the corner cabinet. In this connection, the corner cabinet fitting is of a simple configuration and can be mounted easily; moreover, the corner cabinet requires no special configuration.

DESCRIPTION OF THE PREFERRED EMBODIMENTS

Figure 1:
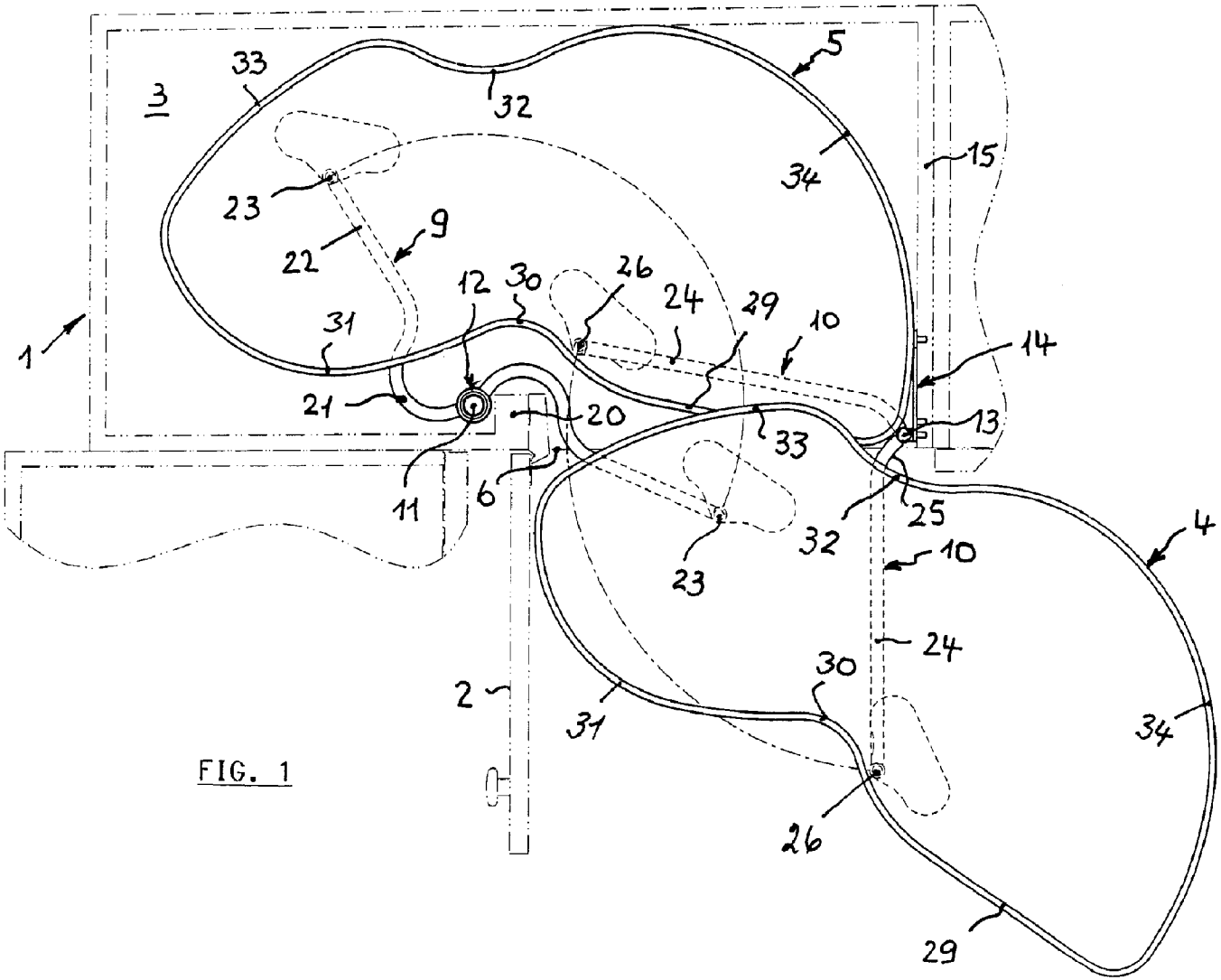
FIG. 1 shows a broken-away schematic plan view of a corner cabinet according to the invention illustrating a first shelf in the interior position and a second shelf in the exterior position.
Figure 3:
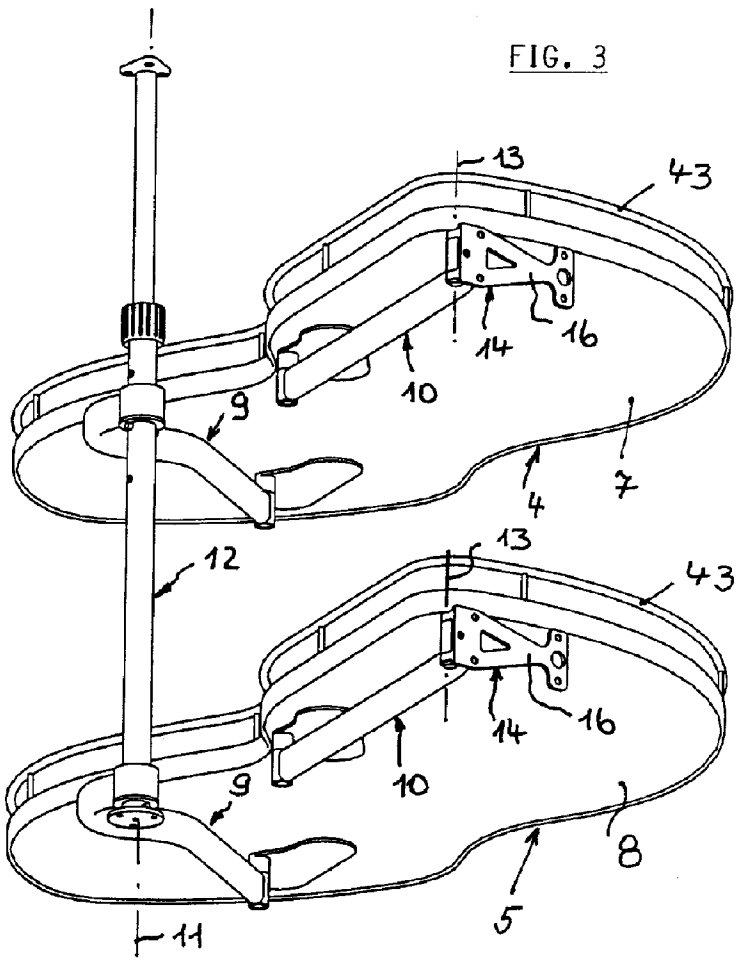
FIG. 3 is an illustration similar to FIG. 2 in a perspective view from the bottom.
Figure 2:
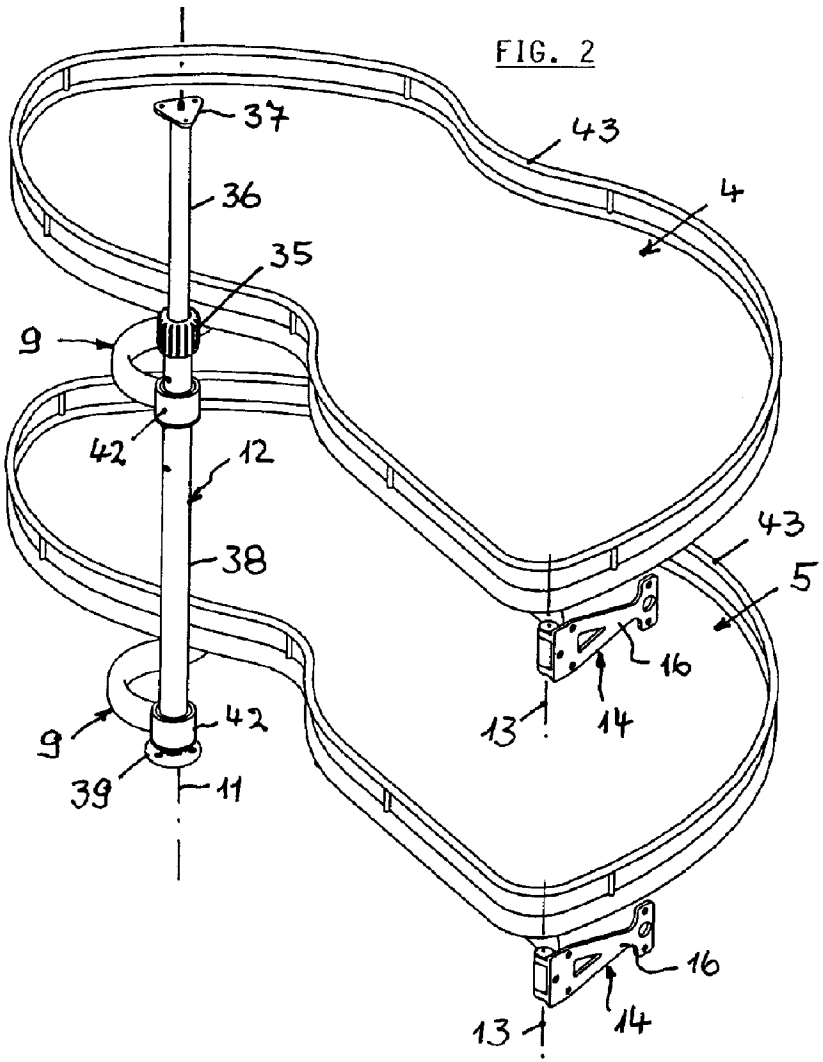
FIG. 2 is an illustration of a corner cabinet fitting with two shelves arranged in vertical alignment above one another in a perspective view from the top.
Figure 4:
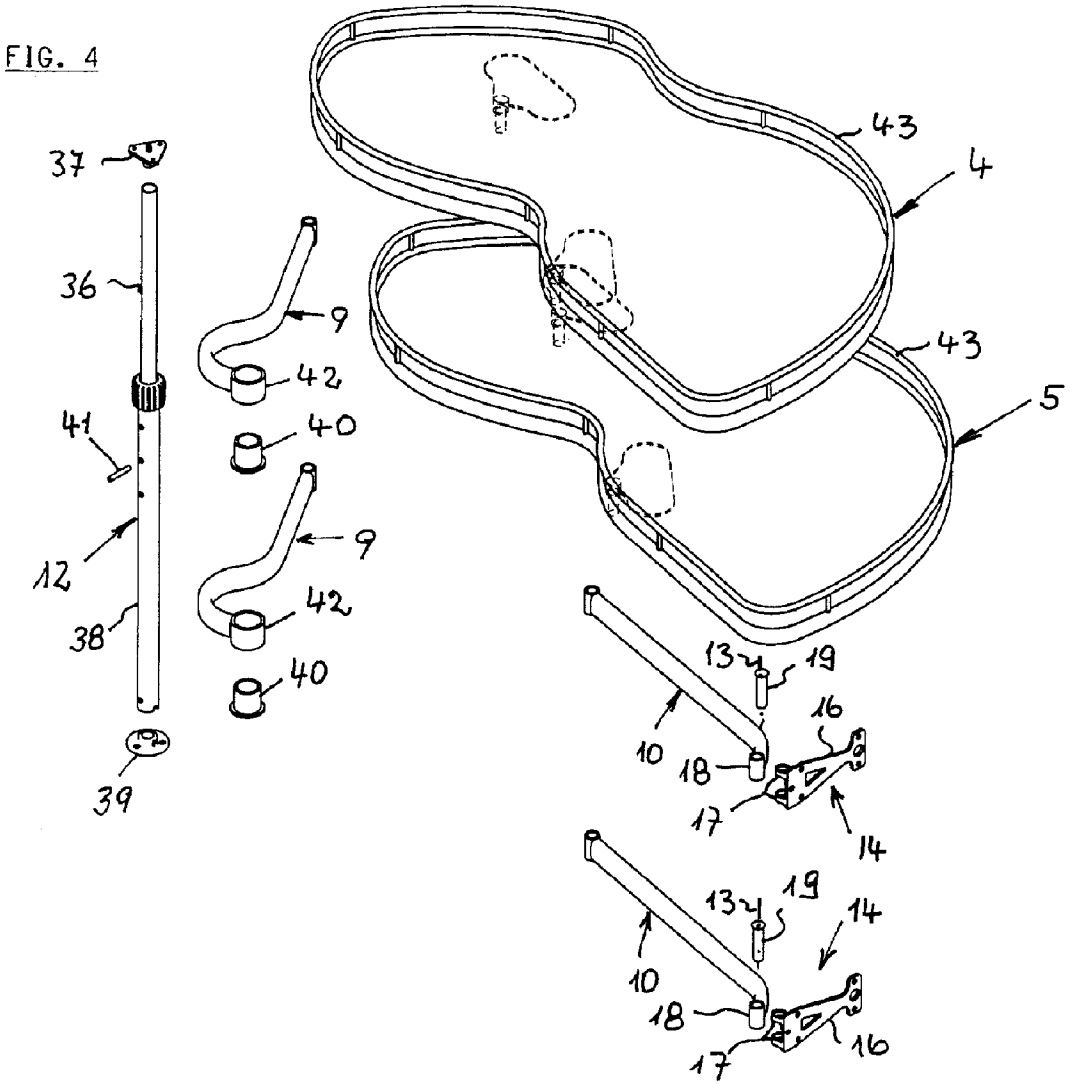
FIG. 4 is an exploded view of the corner cabinet fitting according to FIGS. 2 and 3 for illustrating its components in perspective views.
Figure 5:
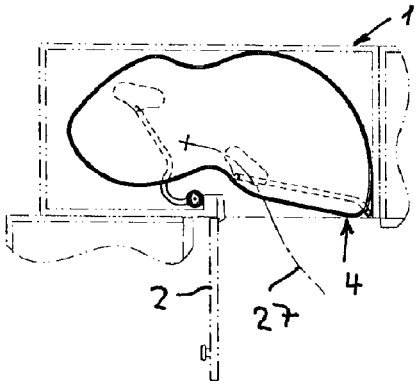
FIG. 5 is an illustration similar to FIG. 1 for illustrating the initial position of the shelf in the interior position within the corner cabinet before being moved into its exterior position.
Figure 6:
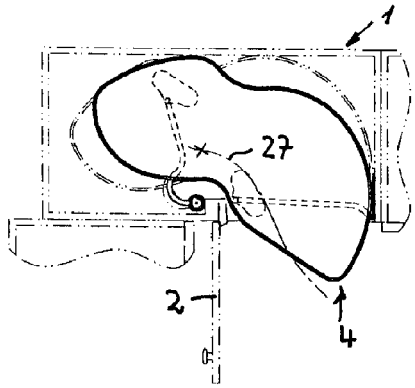
FIG. 6 shows a first intermediate position when moving the shelf from the interior position into its exterior position.
Figure 7:
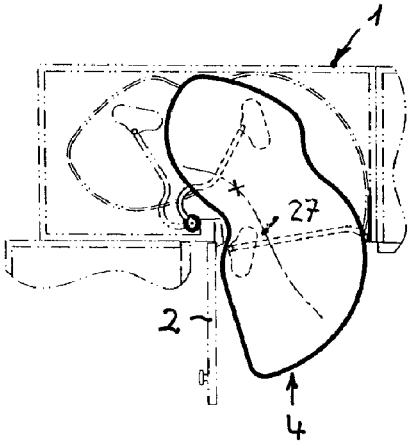
FIG. 7 shows a second intermediate position when moving the shelf from the interior position into its exterior position.

The corner cabinet 1 illustrated in the drawings has an interior 3 that is rectangular in plan view; about one half of the interior 3 is accessible through a corner cabinet door 2 from the cabinet front. In the illustrated embodiment, the interior 3 contains two unitary (one-part) shelves 4, 5 of approximately semi-circular shape. Each shelf 4 can be moved individually or together with the additional shelf or shelves from the interior position within the corner cabinet 1 into the exterior position in which the shelf 4 or 5 projects completely, or substantially completely, e.g. by at least 90 percent of the shelves surface, to the exterior past the plane 6 of the door opening. The corner cabinet 1 or the corner cabinet fitting can be provided with a single shelf, with two shelves as illustrated, but also with more than two shelves that in the interior position or in the exterior position are vertically spaced apart and vertically aligned with one another in the interior.

Each shelf 4, 5 is supported by two guides 9, 10 that are connected pivotably to the bottom side 7 and 8 of the shelf, respectively. The first guide 9 is swivelable about a vertical support column 12 that defines a vertical swivel axis 11 while the second guide 10 is swivelable about an axis 13 of a support bearing 14, which axis 13 extends parallel to the swivel axis 11 of the support column 12. The support bearing 14 is mounted near the plane 6 of the door opening on the sidewall 15 delimiting the door opening and comprises a connecting plate 16 that is provided on the side facing the interior 3 of the corner cabinet 1 with bearing blocks 17 aligned with one another. A boss 18 of the second guide 10 facing the support bearing 14 is interposed between the bearing blocks 17. A journal 19 is inserted into the bearing blocks 17 so as to penetrate the boss 18 and define the swivel axis 13 of the support bearing 14.

The support column 12 is arranged near the corner cabinet post 20 that supports the hinge parts of the corner cabinet door 2. In order for the first guide 9 to be able to assume a position that is required for reaching the exterior position of the shelves 4, 5, the first guide 4 has a curved inner part 21 adjacent to the support column 12 and a substantially radially extending straight outer part 22 that is connected with its outer end to the bottom side 7 or 8 of the shelf 4, 5 so as to be swivelable about a vertical hinge axis 23. The connecting point is positioned to the rear of the shelf 4 or 5 that is proximal to the rear edge of the shelf 4 or 5 (FIG. 1).

In the interior position of the shelf 4, 5, the outer part 22 of the first guide 9 is positioned at an obtuse angle to the plane 6 of the door opening of the corner cabinet. When the shelf 4 or 5 is in its exterior position, the arc-shaped or curved inner part 21 of the first guide 9 surrounds the corner post 20 and is in a position in which the outer part 22 of the first guide 9 is positioned in front of the door opening of the corner cabinet 1 after having carried out a swivel action of approximately 130 to 160 degrees, preferably 145 degrees.

The second guide 10 has a long straight outer part 24 and a short inner part 25 angled relative to the outer part 24 and positioned adjacent to the support bearing 14. In this connection, the end of the outer part 24 of the second guide 10 is connected so as to be pivotable about a vertical axis 26 to the bottom side 7 or 8 of the shelf 4 or 5 wherein the axis 26 of the hinge connection is positioned at a point that is proximal to the forward outer rim of the shelf so that in the interior position of the shelf the outer part 24 of the second guide 10 is positioned at an acute angle to the plane 6 of the door opening of the corner cabinet 1 (FIG. 1). In the exterior position of the shelf 4 or 5, the outer part 24 of the second guide 10 is in a position that is almost parallel to the sidewall 15 of the corner cabinet 1 after having carried out a swivel movement about a swivel angle of approximately 90 degrees to 110 degrees, preferably approximately 100 degrees.

Figure 8:
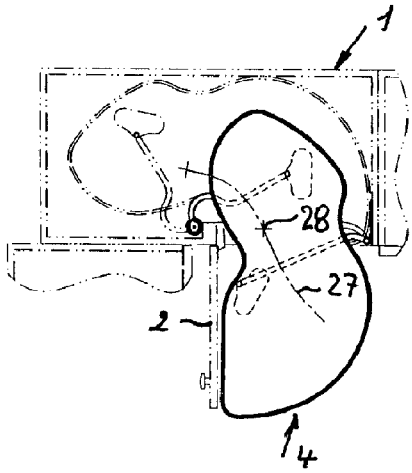
FIG. 8 shows a third intermediate position when moving the shelf from the interior position into the exterior position.
Figure 9:
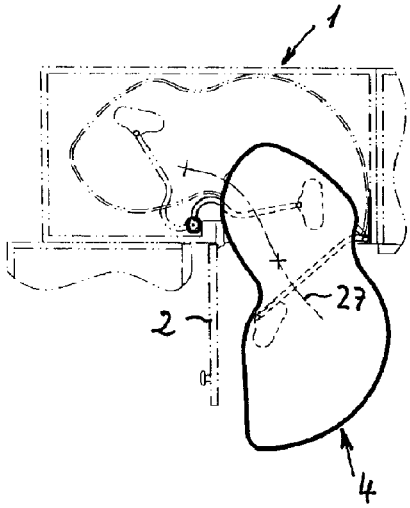
FIG. 9 shows a fourth intermediate position when moving the shelf from the interior position into the exterior position.
Figure 10:
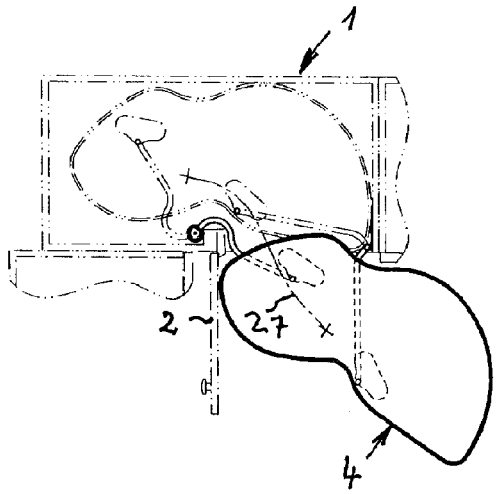
FIG. 10 shows the final exterior position of the shelf.

The movement of the shelf 4 or 5 controlled by the two guides 9, 10 between the interior position and the exterior position comprises two movement phases between which the basic swivel direction of the swivel movement of the shelf 4 or 5 undergoes a directional change. As illustrated in FIGS. 5 to 10, in the illustrated embodiment the shelf 4 or 5 is moved first in the clockwise direction and the swivel direction is changed to a counterclockwise direction starting at an intermediate position in which the outer parts 22 and 24 of the guides 9 and 10, respectively, are approximately in a parallel position (FIG. 8). In the first movement phase, the shelf 4 or 5 carries out a main swivel movement, determined by the first guide 9, in a first swivel direction about the swivel axis 11 of the support column 12 and, at the same time, also an auxiliary swivel movement in the same swivel direction about the axis 23 of the connection of the first guide 9 to the shelf 4 or 5; the auxiliary movement is caused by the second guide 10. In the second movement phase, the shelf 4 or 5 carries out a main swivel movement in a second opposite swivel direction about the axis 13 of the support bearing 14 which main swivel movement is determined by the second guide 10. At the same time, the shelf 4 or 5 carries out an auxiliary swivel movement in the same swivel direction about the axis 26 of the connecting point of the second guide 10 to the bottom of the shelf 4 or 5.

The movement path of a selected point of the shelf 4 or 5 is therefore approximately S-shaped as is illustrated by the course of the movement curve 27 in FIGS. 5 to 10. The same movement path is also carried out by the shelf 4 or 5 when the shelf is returned from the exterior position to the interior position. The lengths of the movement path between the end points and the reversing point 28 of the two movement phases are approximately identical, respectively.

In the illustrated embodiment, a corner cabinet is illustrated that has its door opening at the right half of its front. However, when the door opening is provided on the left half of the front side of a corner cabinet, the same movement courses are present with the difference that in the first movement phase of a movement from the interior position into the exterior position the main swivel movement is counterclockwise.

The contour line of the shelf 4 or 5 is comprised primarily of curved lines whose course is to be determined by taking into account the optimization of the shelf surface size and the course of the movement path 27 as determined by the arrangement and configuration of the guides 9, 10.

In the illustrated embodiment of a corner cabinet 1 with its door opening located to the right of the front of the corner cabinet 1, the front edge of the shelf 4 or 5 in the interior position of the shelf 4 or 5 has a part 29 that is positioned facing the door opening and extends approximately straight; a curved part 30 that in the exterior position of the shelf 4 or 5 surrounds the corner cabinet post 20; and an adjacently positioned second curved part 31 of opposite curvature that approximately corresponds to a circular arc portion and has a radius matching approximately the movement radius of the second guide 10.

The rear edge of the shelf in the interior position of the shelf is delimited by three curved lines of which the central curved line portion 32 has a curvature opposite to the curvature of the neighboring curved line portions 33, 34; the curved line portion 32, when moving the shelf 4 or 5 from the interior position into the exterior position, surrounds the front edge of the sidewall 15 of the corner cabinet 1 delimiting the door opening. The curved line portion 34 that in the interior position of the shelf is positioned proximal to the sidewall 15 delimiting in the door opening is at least substantially formed by a circular arc that extends at least approximately parallel to the circular arc shaped movement path of the point of action (axis 23) of the first guide 9 on the shelf 4 or 5. The curved line portion 33 adjacent to the point of action 23 of the first guide 9 on the shelf 4 or 5 corresponds essentially to a circular arc portion whose center point of the radius (radial center point) coincides approximately with the swivel axis 11 of the support column 12. Of course, it is understood that there is great flexibility regarding the design of the outer contour of the shelf 4 or 5 as well as the design and arrangement of the guides 9, 10. However, this flexibility depends on the dimensions of the shelf surface of the shelf 4 or 5; the flexibility decreases with increasing size of the shelf surface. The shelf surface of the shelf 4 or 5 according to the invention can achieve a size that is approximately, for example, 95 percent, of the surface of a surface-optimized shelf of a semi-circular configuration.

The support column 12 that supports the first guide or guides 9 is preferably changeable with regard to its length; it is a telescoping device and is designed to be secured in its proper mounting length, respectively. For example, a knurled nut 35 acting on clamping members can be employed. The extendable upper part 36 of the support column 12 is provided at its upper end with a connecting plate 37 that can be screwed to the top wall of the corner cabinet 1. The lower end of the lower part 38 of the support column 12 is provided also with an end plate 39 for connecting the support column to the bottom wall of the corner cabinet 1.

The first guide 9 can be swivelled about the support column 12 but is fixed with regard to its vertical position. For example, on the support column 12 a bearing bushing 40 can be rotatably supported whose vertical position is determined, for example, by a transverse plug 41 that penetrates matching transverse bores in the lower part of the support column 12. The first guide 9 is rotatably supported on the bearing bushing 40 by means of a boss 42.

Instead, it is also possible that the first guide 9, at least for the top shelf 4 or 5, is connected to the support column 12 for entrapment upon pivot movement and the ends of the support column 12 are rotatably supported on the bottom wall and top wall of the corner cabinet 1 so that the support column 12 is rotatable as a whole about the axis 11. In such a situation, by swiveling one shelf out of the cabinet, all of the shelves 4 or 5 supported on the support column 12 can be transferred from the interior position into the exterior position. In this connection, it is expedient when the uppermost shelf and/or the additional shelves positioned underneath the uppermost shelf upon return movement from the exterior position into the interior position are not in entraining engagement with the support column 12 so that the shelves can be returned individually.

In regard to the swivel movement of the first guide(s) 9 about the stationary support column 12, basically all shelves are independently movable in and out of the cabinet. However, means can be provided for at least a partial entrapment of shelves into the exterior position when, for example, the uppermost shelf is moved into the exterior position. Moreover, means for at least partial entrapment of the top shelf 4 or the bottom shelf 5 or all shelves of the corner cabinet 1 upon opening or closing the corner cabinet door 2 can be provided.

The shelves 4 and 5 arranged within a corner cabinet 1 and the parts supporting them form a corner cabinet arrangement that is particularly important in connection with kitchen furniture. The corner cabinet fitting requires in comparison to conventional corner cabinet fittings with semi-circular shelves only a few additional parts in the form of a second guide 10 and a support bearing 14 so that the fitting as a whole is of a simple configuration and enables fast and simple mounting. Since the shelves are supported by two guides, the shelves are stable with regard to tilting even when loaded so that they can bear greater loads. The movements of the shelves between the interior and exterior positions are precisely defined so that the shelves always follow a predetermined movement path that is independent of the type of action on the shelf.

The shelves can have a board made of wood, metal, e.g. wiremesh, or plastic or composite material; they are expediently provided with a rail 43 at their edge.

While specific embodiments of the invention have been shown and described in detail to illustrate the inventive principles, it will be understood that the invention may be embodied otherwise without departing from such principles.

What is claimed is:

1. A corner cabinet comprising;

a cabinet door defining a door opening;

a sidewall delimiting a first side of the door opening;

an interior that is rectangular in a plan view, wherein at least one half of the interior is accessible through the door opening;

a fitting arranged in the interior and comprising a support column having a swivel axis that is at least substantially vertical;

at least one unitary shelf supported on the fitting and having a substantially semi-circular shape;

wherein the at least one shelf is movable from an interior position in the interior into an exterior position relative to the corner cabinet, wherein in the exterior position the at least one shelf projects outwardly past a plane of the door opening of the cabinet door;

wherein the fitting comprises a first guide and a second guide for each one of the at least one shelf;

wherein the first and second guides each have a first end pivotably connected at a connecting point to a bottom side of the at least one shelf, respectively;

wherein a second end of the first guide is pivotably connected to the support column;

wherein the fitting further comprises a support bearing having a swivel axis that extends parallel to the swivel axis of the support column, wherein the support bearing is mounted near the door opening on the sidewall;

wherein a second end of the second guide is connected to the support bearing so as to swivel about the swivel axis of the support bearing;

wherein the swivel axis of the support column and the swivel axis of the support bearing are horizontally spaced from one another to allow the first guide to pivot about the swivel axis of the support column past the support bearing and to allow the second guide to pivot about the support bearing past the support column;

wherein the at least one shelf carries out a swivel movement controlled simultaneously by the first and second guides when moving from the interior position into the exterior position and back into the interior position.

2. The corner cabinet according to claim 1, further comprising a corner cabinet post, wherein the support column is arranged near the corner cabinet post.

3. The corner cabinet according to claim 2, wherein the first guide has a straight, substantially radially extending outer part and a curved innerpart connected to the support column, wherein the curved inner part surrounds the corner cabinet post in the exterior position of the at least one shelf.

4. The corner cabinet according to claim 3, wherein, relative to the interior position of the at least one shelf, the outer part of the first guide is connected to a rear area of the at least one shelf and the connecting point is proximal to a rear edge of the at least one shelf and the outer part of the first guide is positioned at an obtuse angle relative to a plane of the door opening.

5. The corner cabinet according to claim 1, wherein the first guide has a swivel range of a swivel angle of approximately 130 degrees to 160 degrees.

6. The corner cabinet according to claim 1, wherein the second guide has a long, straight outer part and a short inner part angled relative to the outer part and connected to the support bearing.

7. The corner cabinet according to claim 1, wherein, relative to the interior position of the at least one shelf, the second guide is connected to a central area of the at least one shelf and the connecting point is adjacent to a front edge of the at least one shelf facing the door opening, wherein the second guide is positioned at an acute angle relative to a plane of the door opening of the corner cabinet in the interior position of the at least one shelf.

8. The corner cabinet according to claim 1, wherein the second guide has a swivel range of a swivel angle of approximately 90 degrees to 110 degrees.

9. The corner cabinet according to claim 1, wherein the swivel movement of the at least one shelf between the interior position and the exterior position comprises a first movement phase and a second movement phase, wherein a basic swivel direction of the swivel movement of the at least one shelf undergoes a directional change at a reversing point between the first and second movement phases.

10. The corner cabinet according to claim 9, wherein, in the first movement phase, the at least one shelf carries out a first main swivel movement in a first swivel direction caused by the first guide about the swivel axis of the support column and, simultaneously, an auxiliary swivel movement in the first swivel direction, caused by the second guide, about an axis of the connecting point of the first guide at the at least one shelf; and wherein, in the second movement phase, the at least one shelf carries out a second main swivel movement caused by the second guide in a second swivel direction opposite the first swivel direction about the axis of the support bearing and, simultaneously, an auxiliary swivel movement in the second swivel direction about an axis of the connection point of the second guide to the at least one shelf.

11. The corner cabinet according to claim 9, wherein a movement path along which the at least one shelf travels when moving from the interior position into the exterior position coincides with a movement path when the at least one shelf moves from the exterior position to the interior position.

12. The corner cabinet according to claim 9, wherein the first and second guides are aligned parallel to one another when the directional change of the basic movement direction occurs.

13. The corner cabinet according to claim 9, wherein a length of the movement path between the interior position and the reversing point and the exterior position and the reversing point, respectively, is approximately identical.

14. The corner cabinet according to claim 1, wherein a contour line of the at least one shelf is comprised primarily of curved lines.

15. The corner cabinet according to claim 14, wherein, in the interior position of the at least one shelf, a front edge of the at least one shelf comprises a substantially straight part facing the door opening, a first curved part extending around a corner cabinet post and having a first direction of curvature, and a second curved part adjoining the first curved part and having a second direction of curvature opposite the first direction of curvature, wherein the second curved part has at least approximately a circular arc shape having a radius matching approximately a radius of movement of the second guide.

16. The corner cabinet according to claim 14, wherein in the interior position of the at least one shelf a rear edge of the at least one shelf is delimited by three curved line portions, comprising a central curved line portion having a first direction of curvature and first and second lateral curved line portions adjoining the central curved line portion and having a second direction of curvature opposite the first direction of curvature, wherein the central curved line portion surrounds the sidewall delimiting the door opening when the at least one shelf moves from the interior position into the exterior position.

17. The corner cabinet according to claim 16, wherein the first lateral curved line portion that in the interior position of the at least one shelf is proximal to the sidewall has at least substantially a circular arc shape that is at least approximately parallel to a circular arc movement path of the connecting point of the first guide to the at least one shelf when the at least one shelf moves from the interior position into the exterior position.

18. The corner cabinet according to claim 16, wherein the second curved line portion neighboring the connecting point of the first guide to the at least one shelf has at least substantially a circular arc shape having a radial center point coinciding approximately with the swivel axis of the support column.

19. The corner cabinet according to claim 1, wherein the fitting comprises a connecting plate connected to the sidewall and wherein the support bearing is a part of the connecting plate.

20. The corner cabinet according to claim 1, wherein the support column is a telescoping device for changing a mounting length of the support column and has securing means securing the support column in a selected mounting length.

21. The corner cabinet according to claim 1, wherein the first guide is pivotable about the support column but has a fixed vertical position on the support column.

22. The corner cabinet according to claim 1, wherein the support column has ends supported on a bottom wall and a top wall of the corner cabinet and is pivotable about the swivel axis of the support column, wherein the first guide entrains the support column when the at least one shelf moves from the interior position into the exterior position.

23. The corner cabinet according to claim 22, wherein several of the at least one shelf comprising a top shelf are provided and are vertically aligned in the interior position above one another and wherein at least one of the several shelves arranged underneath the top shelf is not entrained by the support column when returning the top shelf from the exterior position into the interior position.

24. A fitting for a corner cabinet that has an interior with at least one half of the interior accessible through a cabinet door from the front, the fitting comprising:

a support column stationarily supported vertically within the interior of the corner cabinet as a support for at least one unitary shelf of substantially semi-circular base shape;

a first guide and a second guide for each one of the at least one shelf;

a support bearing adapted to be connected to a sidewall of the corner cabinet delimiting a door opening of the corner cabinet;

wherein the first and second guides control a swivel movement of the at least one shelf from an interior position in the interior of the corner cabinet into an exterior position in front of the door opening of the corner cabinet;

wherein the first and second guides have a first end and a second end, respectively, and are adapted to be connected with the first end pivotably to a bottom side of the at least one shelf, respectively;

wherein the second end of the first guide is connected to the support column defining a first vertical axis and the second end of the second guide is connected to the support bearing defining a second vertical axis such that the second ends swivel about said first vertical axis and said second vertical axis, respectively, wherein the first and second vertical axes are positioned stationarily within the interior of the corner cabinet, and wherein the first and second vertical axes are horizontally spaced from one another to allow the first guide to pivot about the first vertical axis past the support bearing and to allow the second guide to pivot about the second vertical axis past the support column.

25. The fitting according to claim 24, wherein the first guide comprises a straight, substantially radially extending outer part provided with the first end and a curved inner part provided with the second end connected to the support column.

26. The fitting according to claim 25, wherein the first end of the outer part of the first guide is pivotably connectable to a rear area of the at least one shelf at a connecting point proximal to a rear edge.

27. The fitting according to claim 24, wherein the first end of the second guide is pivotably connectable to a central area of the at least one shelf at a connecting point proximal to a front edge of the at least one shelf.

28. The fitting according to claim 24, wherein, in a mounted position of the fitting, the first and second guides control the swivel movement of the at least one shelf from the interior position into the exterior position in two movement phases, wherein a directional change of the swivel movement takes place at a reversing point between the first and second movement phases.

29. The fitting according to claim 24, wherein the support column is a telescoping device for changing a mounting length of the support column and has securing means securing the support column in a selected mounting length.

30. The fitting according to claim 24, comprising a connecting plate adapted to be screwed to a sidewall of the corner cabinet neighboring the door opening, wherein the support bearing is a part of the connecting plate.

* * * * *